US008936090B2

(12) United States Patent
Sultenfuss et al.

(10) Patent No.: US 8,936,090 B2
(45) Date of Patent: Jan. 20, 2015

(54) INLINE RF HEATING FOR SAGD OPERATIONS

(75) Inventors: Daniel R. Sultenfuss, Houston, TX (US); Wayne R. Dreher, Jr., College Station, TX (US); Thomas J. Wheeler, Houston, TX (US); Francis E. Parsche, Palm Bay, FL (US); Mark A. Trautman, Melbourne, FL (US)

(73) Assignees: ConocoPhillips Company, Houston, TX (US); Harris Corporation, Melbourne, FL (US)

( * ) Notice: Subject to any disclaimer, the term of this patent is extended or adjusted under 35 U.S.C. 154(b) by 623 days.

(21) Appl. No.: 13/232,451

(22) Filed: Sep. 14, 2011

(65) Prior Publication Data

US 2012/0061080 A1 Mar. 15, 2012

Related U.S. Application Data

(60) Provisional application No. 61/382,675, filed on Sep. 14, 2010, provisional application No. 61/448,882, filed on Mar. 3, 2011.

(51) Int. Cl.

| | |
|---|---|
| ***E21B 36/04*** | (2006.01) |
| ***E21B 43/24*** | (2006.01) |
| ***E21B 43/30*** | (2006.01) |

(52) U.S. Cl.

CPC ..... *E21B 43/30* (2013.01); *E21B 43/2406* (2013.01); *E21B 43/2408* (2013.01); *E21B 43/2401* (2013.01)

USPC ..... 166/303; 166/60; 166/272.3

(58) Field of Classification Search

USPC ..... 166/302, 303, 248, 60, 272.3

See application file for complete search history.

(56) References Cited

U.S. PATENT DOCUMENTS

| | | | | |
|---|---|---|---|---|
| 2,757,738 | A | 8/1956 | Ritchey | |
| 3,522,848 | A | 8/1970 | New | |
| 4,638,863 | A | 1/1987 | Wilson | |
| 5,109,927 | A * | 5/1992 | Supernaw et al. | 166/248 |
| 5,236,039 | A | 8/1993 | Edelstein et al. | |
| 7,091,460 | B2 | 8/2006 | Kinzer | |
| 8,646,524 | B2 * | 2/2014 | Al-Buraik | 166/248 |
| 2003/0155111 | A1 * | 8/2003 | Vinegar et al. | 166/59 |
| 2005/0072567 | A1 * | 4/2005 | Steele et al. | 166/272.3 |
| 2007/0289736 | A1 | 12/2007 | Kearl et al. | |
| 2008/0073079 | A1 * | 3/2008 | Tranquilla et al. | 166/270.1 |
| 2009/0020456 | A1 | 1/2009 | Tsangaris et al. | |
| 2010/0108318 | A1 * | 5/2010 | Diehl et al. | 166/272.3 |
| 2010/0294488 | A1 | 11/2010 | Wheeler et al. | |
| 2010/0294489 | A1 | 11/2010 | Dreher, Jr. et al. | |

FOREIGN PATENT DOCUMENTS

| | | |
|---|---|---|
| WO | WO2010/107726 | 9/2010 |
| WO | PCT/US11/51557 | 9/2011 |

* cited by examiner

*Primary Examiner* — Catherine Loikith

(74) *Attorney, Agent, or Firm* — Boulware & Valoir

(57) ABSTRACT

A method is described for accelerating start-up for SAGD-type operation by providing radio frequency heating devices inside the lateral wells that can re-heat the injected steam after losing heat energy during the initial injection. The method also extends the lateral wells such that the drilling of vertical wells can be reduced to save capital expenses.

23 Claims, 3 Drawing Sheets

INLINE RF HEATING FOR SAGD OPERATIONS

PRIOR RELATED APPLICATIONS

This invention claims priority to U.S. Provisional Nos. 61/382,675, filed Sep. 14, 2010, and 61/448,882, filed Mar. 3, 2011, each of which is incorporated by reference in its entirety herein.

FIELD OF THE INVENTION

The invention relates to a method for accelerating the start-up preparation period for SAGD-type operations, and particularly to a method for accelerating the start-up preparation period for SAGD-type operations by providing inline heaters along the well length, especially radio frequency heating devices.

BACKGROUND OF THE INVENTION

Many countries in the world have large deposits of oil sands, including the United States, Russia, and various countries in the Middle East. However, the world's largest deposits occur in Canada and Venezuela. Oil sands are a type of unconventional petroleum deposit. The sands contain naturally occurring mixtures of sand, clay, water, and a dense and extremely viscous form of petroleum technically referred to as "bitumen," but which may also be called heavy oil or tar.

The crude bitumen contained in the Canadian oil sands is described as existing in the semi-solid or solid phase in natural deposits. Bitumen is a thick, sticky form of crude oil, so heavy and viscous (thick) that it will not flow unless heated or diluted with lighter hydrocarbons. The viscosity of bitumen in a native reservoir is high. Often times, it can be in excess of 1,000,000 cP. Regardless of the actual viscosity, bitumen in a reservoir does not flow without being stimulated by methods such as the addition of solvent and/or heat. At room temperature, it is much like cold molasses.

Due to their high viscosity, these heavy oils are hard to mobilize, and they generally must be made to flow in order to produce and transport them. One common way to heat bitumen is by injecting steam into the reservoir. The quality of the injected fluid is very important to transferring heat to the reservoir to allow bitumen to be mobilized. Quality in this case is defined as percentage of the injected fluid in the gas phase. The target fluid quality is near 100% vapor, however, injected fluid in parts of the well can have a quality below 50 percent (more than 50% liquid) due to heat loss along the wellbore.

Lesser quality injection fluid has a lower latent heat to transfer to the reservoir, causing inefficiencies and difficulties in oil sands operations, such as irregular shaped steam chambers, control issues, and reduction in mobilized fluids. In steam assisted gravity drainage, lower quality steam is generally observed at the end of the well due to steam condensing as it goes farther into the well and loses heat. This limits the practical length of lateral wells in steam assisted gravity drainage project to less than 1,000 meters.

One theoretical way of heating the wellbore, reducing latent heat losses and allowing longer wells might be to apply electromagnetic energy to the wellbore and/or fluid therein. Electromagnetic waves can certainly heat various materials, and microwave energy is often used to heat water. However, no one has used RF waves in this capacity before, although RF has been used in other down-hole applications.

U.S. Pat. No. 2,757,738, for example, is a very early publication disclosing a method for heating subsurface oil reservoir bearing strata by radio frequency electromagnetic energy, where the RF electromagnetic energy is generated by a radiator within a vertical well bore. The antennas of this method are not immersed in the ore for extended distance because the well bores are vertically drilled. Additionally, the vertically drilled well bores have inherent limitations on separating the charges between horizontal earth strata.

U.S. Pat. No. 3,522,848 discloses radiation generating equipment for amplifying the oil production in a natural reservoir. In essence radio frequency electromagnetic waves are used to heat the dry exhaust gas (comprising $CO_2$ and nitrogen) of an internal combustion engine, and the heated gas is subsequently used to heat the reservoir to reduce the viscosity of the hydrocarbons contained in the natural reservoir.

U.S. Pat. No. 4,638,863 discloses a method for stimulating the production of oil by using microwave to heat a non-hydrocarbonaceous fluid (such as brine) surrounding a well bore, and the heated non-hydrocarbonaceous fluid will in turn heat the hydrocarbonaceous fluid in the same formation.

U.S. Pat. No. 5,236,039 provides a system for extracting oil from a hydrocarbon bearing layer by implementing RF conductive electrodes in the hydrocarbon layer, the RF conductive electrodes having a length related to the RF signal. The spacing between each RF conductive electrodes and the length of such electrodes are calculated so as to maximize the heating effect according to the frequency of the RF signal. However, the inventors' experiences indicate that standing wave patterns do not form in dissipative media, such as hydrocarbon ores, because the energy will be dissipated as heat long before significant phase shift occurs in the propagation of electromagnetic energies. Thus, this method is of limited use.

U.S. Pat. No. 7,091,460 discloses a method for heating a hydrocarbonaceous material by a radio frequency waveform applied at a predetermined frequency range, followed by measuring an effective load impedance initially dependent upon the impedance of the hydrocarbonaceous material, which is compared and matched with an output impedance of a RF signal generating unit.

US20070289736 discloses a method of in situ heating of hydrocarbons by using a directional antenna to radiate microwave energy to reduce the viscosity of the hydrocarbon. The method preferably applies sufficient energy to create fractures in the rock in the target formation, so as to increase the permeability for hydrocarbons to flow through the rough and be produced. However, directional antennas are not practical at the frequencies required for useful penetration, because the instantaneous half depth of penetration may be too short. For example a 2450 MHz electromagnetic energy in rich Athabasca oil sand having conductivity of 0.002 mhos/meter is 9 inches. Thus, this method is also of limited use.

WO2010107726 discloses a process for enhancing the recovery of heavy hydrocarbons from a hydrocarbon formation. Microwave generating devices are provided in horizontal wells in the formation, and a microwave energy field is created by the microwave generating devices, so that the viscosity of the hydrocarbons within the microwave energy field can be reduced and more readily produced. Electronic waves must be generated for this method to work, limited its usefulness.

However, none of the abovementioned literature discloses a method or system that addresses the issue of loss of latent heat of the steam during SAGD start-up operation, which may allow the extension of lateral well and reduce the number of wells being drilled. Thus, what is needed in the art is a method of efficiently heating the wellbore, such that longer wells can efficiently be used without latent heat losses.

SUMMARY OF THE INVENTION

Generally, speaking, the invention relates to using a radio frequency heating device in a well to heat the wellbore and/or the injected fluid so as to increase the efficiency of the heat transfer into reservoir, improve conformance along a wellbore, and allow for the extension of lateral wells beyond current specifications.

Steam assisted gravity drainage (SAGD) is a commercial recovery process used for recovering heavy oil and bitumen that possess low to no mobility under native reservoir conditions. Steam assisted processes such as SAGD and cyclic steam stimulation are the only commercial oil producing methods in the Athabasca oil sands in areas that can not be surface mined. This constitutes about 80% of the over 1.3 trillion bbls of bitumen resource in place in the Athabasca oil sands.

As steam and/or heated solvents are injected into the reservoir, they lose some heat to the wellbore and wellbore fluids prior to being pumped into the reservoir. Thus, the quality of the fluid (heat level) is greatly diminished by the time it reaches the formation. Placing one or more RF heating devices or other inline heating devices along the well length allows reheating of the fluid (vaporize) and/or wellbore itself and will increase the heat transfer efficiency of the fluid into the reservoir and allow the use of longer wells, thus improving the cost effectiveness of operations. The RF devices can be used in horizontal or vertical injection wells and two examples of possible uses are displayed in FIGS. 1 and 2.

Capital expenses of steam assisted processes would also be lowered by reducing the number of wells required to recover an area of a resource. Currently, horizontal injection wells are limited to about 1000 meters due to poor quality fluid at the end of the well. The low quality fluid at the end of the well can also cause conformance issues along the wellbore. The shape of the SAGD steam chamber can become irregular where lower heat penetration is observed. This can cause operational issues that will lead to decreased production and the possibility of stranded oil. Reheating the fluid downhole will allow high quality fluids to reach much farther into the formation, allowing for evenly heated wells and the ability to use much longer wells.

In addition to increasing the efficiency of heat transfer into the reservoir, the inline RF heater has the potential to reduce the surface footprint of a commercial oil development. By using longer wells, fewer wells will have to be drilled, thus significantly reducing surface disturbances and decreasing the total coast of the project. Surface disturbances could be reduced by over sixty percent when compared to a standard SAGD operation and more of the in place resource will be contacted due to less well pads and vertical sections of reservoirs being present in the pay zone.

The SAGD process can start by drilling at least two horizontal wells. The producer can be located 1-2 meters from the bottom of the reservoir and the steam injector three to seven meters above the producer, and both are typically placed near the bottom of a payzone. As steam continues to be injected, the latent heat of vaporization of water drives the ability to melt and subsequently drain fluids for production. In the SAGD process, the produced fluid consists of an oil and water emulsion that can contain as much as 70% (w/w) water.

In order to initiate SAGD production, fluid and pressure communication must be established between the horizontal injector and horizontal producer. This is currently achieved by circulating steam in each of the horizontal wells and through conductive heat transfer with minor convective heat transfer, the in situ reservoir fluids and reservoir rock between the wells is heated, mobilizing the bitumen and allowing thermal, pressure and fluid communication between the wells to be established. Depending on formation lithology (i.e. reservoir heterogeneity) and actual interwell vertical spacing, this preheating period normally takes three months or more before sufficient mobility of the bitumen is established (bitumen temperatures >80° C.) and the process can be converted to SAGD.

The use of radio frequency devices focused on heating the wellbore and/or fluid within allows longer wells to be used. Preferably, an inline RF heater is placed inline at about 1000 meters, and this allows the increase of well length to 2000 meters. If needed, RF heaters can be placed every 500 m, 750 m or 1000 meters, or thereabouts, depending on heat capacity of the surrounding formation.

One device that can be used is a directional radiation antenna, which can be located in or on the wells (the producer, injector or the producer and the injector). A specific frequency can be utilized that will target the fluid required to be heated, and typically microwave energy can be used to heat water, thus vaporizing it. The heat added to the reservoir in this manner can be more effective than the conductive heating process currently used. FIG. 1 shows one possible configuration of using the RF heaters with steam circulation to establish communication between the two horizontal wells.

The present invention relates to a process of extending a lateral well of a steam assisted gravity drainage operation. The process involves inserting a radio frequency heating device into the lateral well and operating the radio frequency heating device along the lateral well. Through the deployment of the radio frequency device into the lateral well, the steam that has lost heat during injection can be re-heated by the radio frequency heating device.

Through judicious choice of RF frequency, intensity and proximity, it will also be possible to induce induction heating in the wellbore itself. Induction heating is the process of heating an electrically conducting object (usually a metal) by electromagnetic induction, where eddy currents (also called Foucault currents) are generated within the metal and resistance leads to Joule heating of the metal.

In an alternate embodiment the process describes first extending a lateral well from a normal length of about 1000 meters by at least another 1,000 meters of a steam assisted gravity drainage operation. In this embodiment a first radio frequency heating device is placed within 20 meters of the heel of the lateral well. A second radio frequency heating device is placed at a distance greater than 500 meters along the lateral well. Both the first radio frequency heating device and the second radio frequency heating device are then operated along the lateral well. Additional RF heaters can be added with increasing length.

The following abbreviations are used herein:

| | |
|---|---|
| SAGD | Steam assisted gravity drainage |
| RF | Radio frequency |

Activators are optional, but if desired can also be added to the injection fluids, in order to increase the absorption of RF energy. Generally speaking, activators are defined as RF absorbing molecules. Typical activators are metal containing asymmetric molecules that have a dipole, and thus are subject to rotational heating due to absorption of RF energies. Activators include divalent or trivalent metal cations. Other examples of activators suitable for the present invention include inorganic anions such as halides. In one embodiment the activator could be a metal containing compound such as those from period 3 or period 4 of the periodic table. In another embodiment the activator could be a halide of Na, Al, Fe, Ni or Zn, including $AlCl_4^-$, $FeCl_4^-$, $NiCl_3^-$, $ZnCl_3^-$ and combinations thereof. Other suitable compositions for the activator include transitional metal compounds or organometallic complexes. Other suitable compositions for the activator include transitional metal compounds or organometallic complexes. The more efficient an ion is at coupling with the MW/RF radiation the faster the temperature rise in the system. In one embodiment the added activator would not be a substance already prevalent in the crude oil or bitumen. Substances that exhibit dipole motion that are already in the stratum include water, salt and asphaltenes.

As used herein, "hydrocarbon formation" refers to a geological formation holding hydrocarbon resources such as crude oil, bitumen or natural gas.

The use of the word "a" or "an" when used in conjunction with the term "comprising" in the claims or the specification means one or more than one, unless the context dictates otherwise.

The term "about" means the stated value plus or minus the margin of error of measurement or plus or minus 10% if no method of measurement is indicated.

The use of the term "or" in the claims is used to mean "and/or" unless explicitly indicated to refer to alternatives only or if the alternatives are mutually exclusive.

The terms "comprise", "have", "include" and "contain" (and their variants) are open-ended linking verbs and allow the addition of other elements when used in a claim.

DESCRIPTION OF EMBODIMENTS OF THE INVENTION

Figure 1:
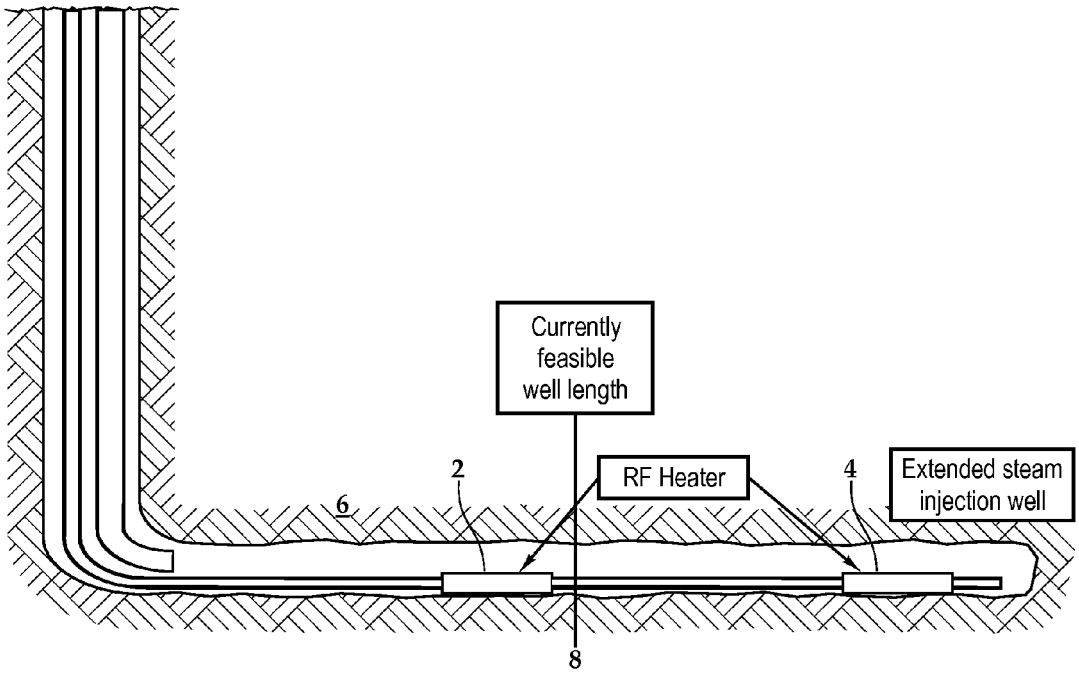
FIG. 1 depicts the exemplary placement of the radio frequency heating devices within a lateral well.

The invention provides a novel process for extending the lateral well of a steam assisted gravity drainage operation by providing a radio frequency heating device into the lateral well within a hydrocarbon formation and operating the radio frequency heating device along the lateral well, so as to reheat the steam and/or wellbore. In an embodiment, the lateral well can be extended beyond 1,000 meters with the insertion of the radio frequency heating device. In a preferred embodiment, the lateral well can be extended beyond 2,000 meters.

In one embodiment, the method of the present invention includes providing at least one radio frequency heating device, and in a preferred embodiment a first and a second radio frequency heating devices are provided in the lateral well. The distance between the first and second radio frequency heating devices can vary, depending on the practical application of the heating devices. In one embodiment, the distance between the first and second heating devices is greater than 500 meters. In another embodiment, the distance between the first and second devices is greater than 1,000 meters.

The placement of the first radio frequency heating device, in an embodiment, is within 20 meters of the heel of the lateral well. In such placement, the distance between the first and second heating device may vary, and preferably greater than 1,000 meters, and more preferably greater than 500 meters.

The following examples are illustrative only, and are not intended to unduly limit the scope of the invention.

Using a radio frequency heating device in the well to heat or reheat fluids as they are injected can allow more energy to be transferred to the reservoir and thus allow greater production potential and allow wells to be extended beyond their current lengths. In addition using radio frequencies to heat the formation and bitumen reduces the time required and the costs associated with SAGD startup.

The RF device is used can be a directional radiation antennae that is located on the outside of the wells used in the process. The specific frequency or frequencies that will be utilized will be fixed, but one can target one or more fluid components that require heating, and other can target metal components of the wellbore.

For example, if the quality of the steam is important to the process then a frequency which allows for efficient coupling with water will be chosen in order to reheat/vaporize water as it condenses within the reservoir. If the process incorporated a RF susceptible solvent, then a frequency that best couples with the solvent will be used. In some cases multiple frequencies may be chosen if the recovery process used both solvent and steam such as in ES-SAGD operations.

In yet an alternate embodiment the method describes a process to accelerate SAGD start-up by reducing time required to establish communication between the injection and production wells during the circulation period. This approach uses radio frequencies to heat the area between and around the two wells in order to reduce the startup time for SAGD. The process can be stand alone or used in conjunction with current steam circulation methods.

In another embodiment of the process, injection of water, solvents (diesel, xylene, hexane, etc.) and gases (methane, carbon-dioxide, butane, propane, etc.) may occur simultaneously while applying RF radiation to further accelerate bitumen mobilization. This can be achieved by focusing the RF frequency for water heating and generating steam when water is injected during start-up, or by taking advantage of the thermal, as well as, the solvent viscosity reduction when solvents and gases are injected.

As described the method can be focused on preheating a SAGD well pair in a bitumen reservoir. It should be noted that heavy oil reservoirs also exist where this process could be used to decrease start-up time. There are also a number of other processes besides SAGD that require interwell heating prior to start-up that this method can be applied to. A few of these processes include ES_SAGD, JAGD, V APEX CSS, and SWAGD. For example in ES-SAGD, the frequencies used could be tailored to the fluid for optimal heating and the solvent used could also be receptive or non-receptive to RF heating in order to optimize the process.

The transducer of the radio frequency heating device may operate in power range from 100 kW to 10 MW as needed to affect the desired steam quality at the exit of the transducer. The power may be applied at a steady rate or cyclically in order to heat the water in the wellbore. The length of the transducer may be as short as 1 m or as long as the well extension.

The RF transducer may be hollow and have openings that allow the process water to flow through it or it may be sealed or solid so that the water flows around it. In the former, the water is heated in the interior of the transducer, whereas in the latter the water is heated on the exterior of the transducer.

The radio frequency heating device may convert the radio frequency electric current in heat energy by dissipation. The form of the radio frequency device is elongated to facilitate insertion into the well. Radio frequencies from 50 to 500 MHz may be applied to the heating device. The radio frequency heating device may be made of metal such as iron, steel, copper, aluminum or brass that have properties intrinsic to providing the conversion of radio frequency energy into heat. As can be appreciated the resistance of these metals increases linearly with temperature which provides for increased heating stability. The electrical currents may range from 100 to 1000 amperes.

Turning now to the detailed description of the preferred arrangement or arrangements of the present invention, it should be understood that the inventive features and concepts may be manifested in other arrangements and that the scope of the invention is not limited to the embodiments described or illustrated. The scope of the invention is intended only to be limited by the scope of the claims that follow.

The present embodiment describes a process of extending a lateral well of a steam assisted gravity drainage operation. The process involves inserting a radio frequency heating device into the lateral well and operating the radio frequency heating device along the lateral well.

This process can be used for any pre-existing, existing, or future planned steam assisted gravity drainage operation where there exists a need to extend the lateral well or to increase production from the toe of the lateral well. In one embodiment the process can be used to extend the lateral well beyond 1,000 meters, 1,500 meters or even 2,000 meters. Under conventional steam assisted gravity drainage operations extending the lateral well to these lengths would not be economically feasible due to the heat losses toward the toe of the lateral well.

Increased steam quality can be calculated by the percentage of actual steam versus liquid water in the well. Typically as steam is forced or produced downhole a certain percentage of the steam will eventually condense into liquid water. Increased steam is able to help the production of heavy oil by providing additional latent heat to the formation, thereby increasing the hydrocarbons produced by the well.

In one embodiment steam assisted gravity drainage operation is meant to include conventional steam assisted gravity drainage operation in addition to expanding solvent-steam assisted gravity drainage, cyclic steam stimulation operation, and the many variations thereon.

In one embodiment the distance along the lateral well between a first radio frequency heating device and a second radio frequency heating device is greater than 500, 750 or even 1,000 meters. As the steam quality degrades along the horizontal well, the second radio frequency heating device increases the stream quality. The steam quality can be increased by the second radio frequency heating device to be greater than 80%, 85%, 90%, 95%, even 100% steam when compared the amount of liquid water in the well. By reducing the amount of liquid water and increasing the amount of steam in the well additional latent heat is added to the formation.

In one embodiment a first radio frequency heating device is placed within 20 meters of the heel of the lateral well and the distance along the lateral well between the first radio frequency heating device and a second radio frequency heating device is greater than 500 meters.

In another embodiment it is also possible to have more than two radio frequency heating devices. In this embodiment to ensure the quality of the steam radio frequency heating devices can be placed every 50, 100, 200, 300, 400 500, 600, 700 or even 800 meters apart.

In one embodiment a specific activator is injected into the well. By injecting a specific activator one skilled in the art would have the requisite knowledge to select the exact radio frequency or microwave frequency required to achieve maximum heating of the activator. Therefore, the current method eliminates the need to arbitrarily generate variable microwave frequency, which may or may not be able to efficiently absorb the microwave or RF radiation. This method would cause the radio frequencies generated by the radio frequency heating device to more efficiently transfer into the water of the steam assisted gravity drainage operation.

FIG. 1 depicts the placement two radio frequency heating devices 2, 4 along a lateral well 6. In this embodiment line 8 demonstrates the current feasible well length. By added in the second radio frequency heating device 4 the length of the lateral well 6 is extended.

Figure 2A:
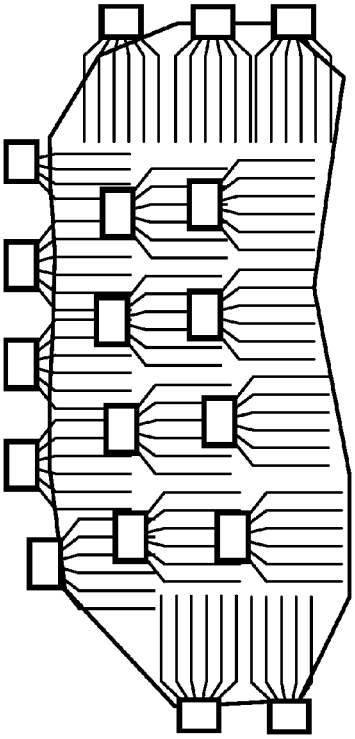
FIG. 2 shows the comparison between unextended lateral wells (2*a*) and extended lateral wells (2*b*), each of which is represented by lines, and shows that the use of longer wells means that fewer pads (black boxes) are needed on the surface. Reheating the condensed water in the wellbore allows for the use of longer wells by enabling high quality steam to reach the toe, no matter how long the well is. These longer wells would reduce the surface footprint required to drill the horizontal wells required to recover the resource, as the well could be twice as long, and operators would not have to have as many surface pads (black boxes in the figure) to drill from. This invention also allows long wells to reach resources that would otherwise be stranded due to surface conditions (lakes, rivers, man made features, etc.) that prevent surface footprint within range of resource.
Figure 2B:
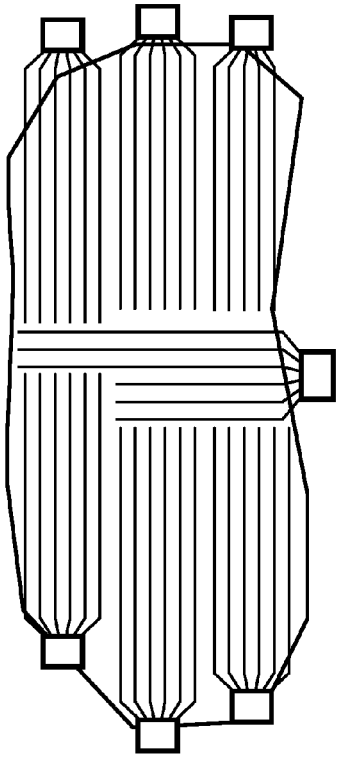

FIG. 2 depicts two scenarios. In the FIG. 2*a* the length of lateral wells are not extended. As a result it can be shown that additional well pads are needed to effectively produce oil. FIG. 2*b* shows an embodiment of this process where the lateral wells are extended thereby eliminating the need for additional horizontal wells and additional well pads.

Figure 3:
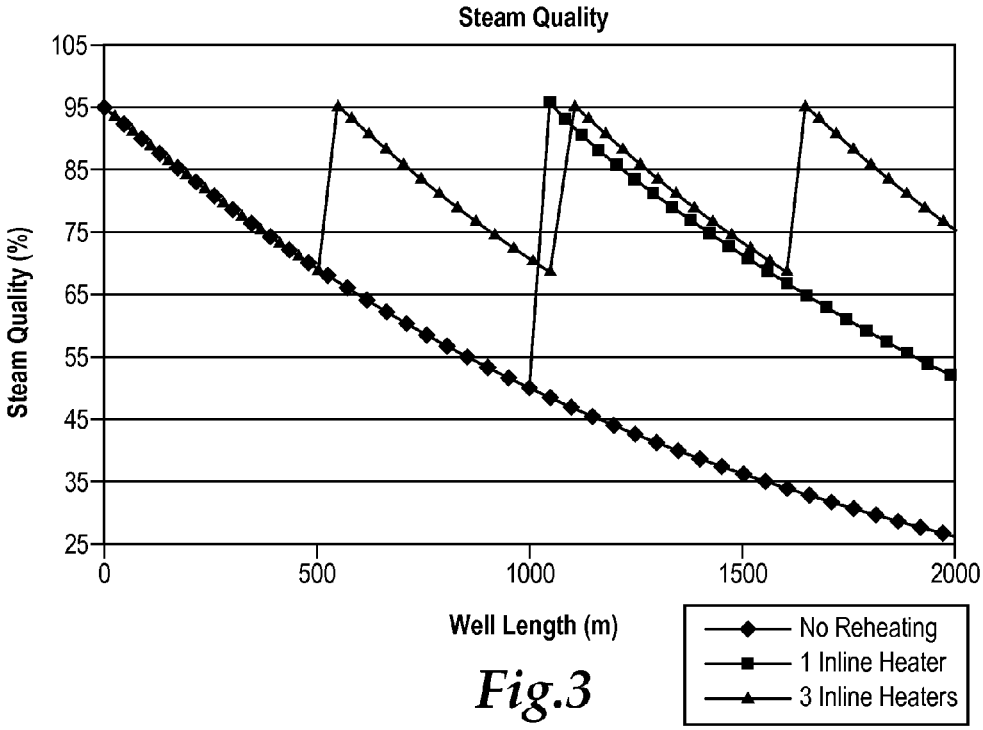
FIG. 3 shows the simulation graph of well length versus steam quality, which drops off when there is no inline heating (diamond), and improves for each inline RF heater (square is two heaters, triangle one heater).
Figure 4:
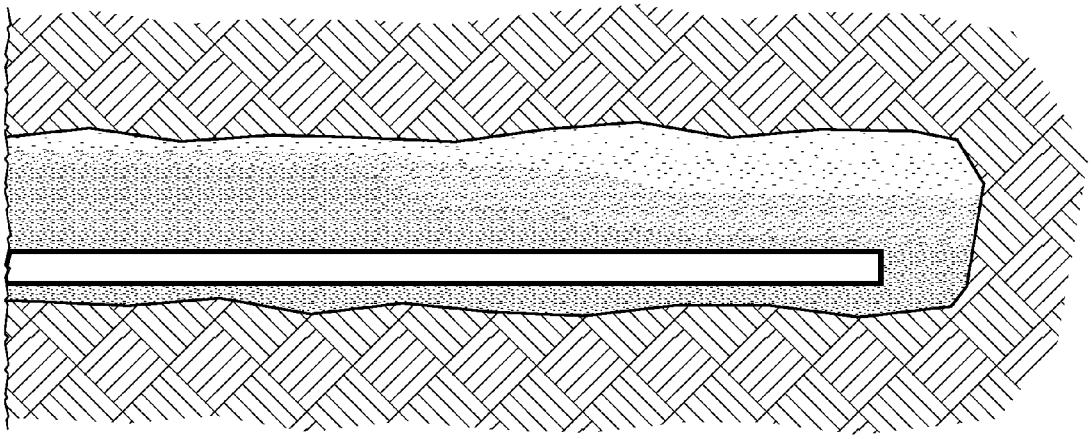
FIG. 4 illustrates the irregular steam chamber caused by heat loss towards the toe of the well. Such heat loss are avoided with inline RF heaters, and the steam chamber with thus be more robust at the toe of the well, and longer well can be used with the resulting reduction in impact and cost savings.

FIG. 3 shows the heating effect of inline RF heaters, and FIG. 4 shows the uneven steam chamber resulting with normal heat losses along the wellbore.

Figure 5:
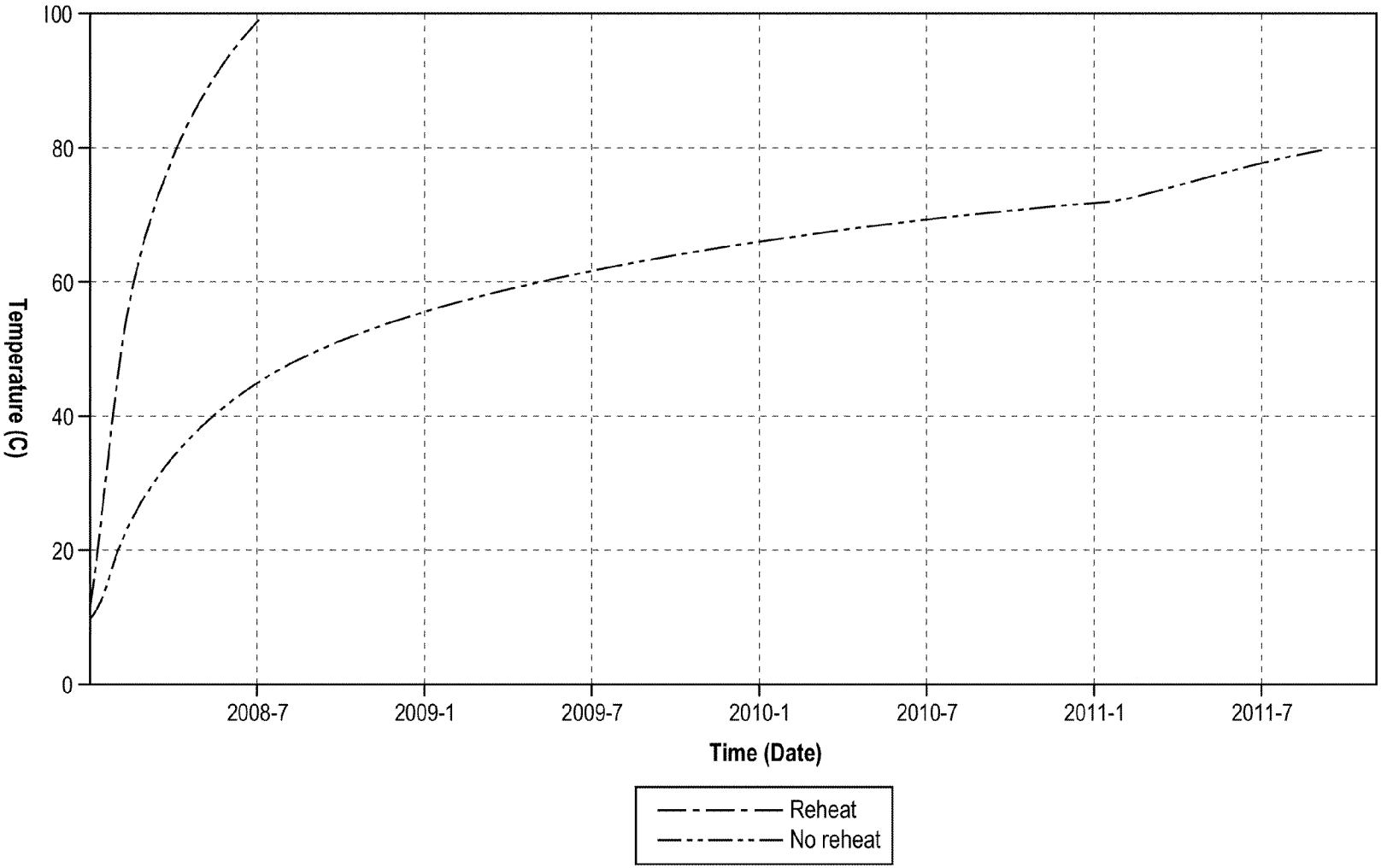
FIG. 5 shows simulated time versus heating, and it is apparent that adding inline RF heaters allows a faster increase in temperature.

FIG. 5 shows the simulation results of using the radio frequency heating devices to re-heat the steam as compared to not using such heating devices. As can be clearly seen in the figure, using the radio frequency heating devices can accelerate the start-up period for an SAGD operation (reaching temperature of 80° C.), and that translates to significantly reduced heating time, as well as operating costs and expenses.

In closing, it should be noted that the discussion of any reference is not an admission that it is prior art to the present invention, especially any reference that may have a publication date after the priority date of this application. At the same time, each and every claim below is hereby incorporated into this detailed description or specification as additional embodiments of the present invention.

Although the systems and processes described herein have been described in detail, it should be understood that various changes, substitutions, and alterations can be made without departing from the spirit and scope of the invention as defined by the following claims. Those skilled in the art may be able to study the preferred embodiments and identify other ways to practice the invention that are not exactly as described herein. It is the intent of the inventors that variations and equivalents of the invention are within the scope of the claims while the description, abstract and drawings are not to be used to limit the scope of the invention. The invention is specifically intended to be as broad as the claims below and their equivalents.

The following references are incorporated by reference in their entirety.

1. U.S. Pat. No. 2,757,738
2. U.S. Pat. No. 3,522,848
3. U.S. Pat. No. 4,638,863
4. U.S. Pat. No. 5,236,039
5. U.S. Pat. No. 7,091,460
6. U.S. Patent Publication No. 20070289736
7. U.S. Patent Publication No. 20100294488
8. WO 201007726

What is claimed is:

1. A process comprising:

a) extending a lateral well of a steam assisted gravity drainage operation within a hydrocarbon formation;

b) inserting at least one radio frequency heating device into the lateral well; and c) operating the at least one radio frequency heating device along the lateral well to reheat steam in said extended lateral well.

2. The process of claim 1, wherein the lateral well is extended beyond 1,000 meters.

3. The method of claim 1, wherein the lateral well is extended beyond 2,000 meters.

4. The method of claim 1, wherein the at least one radio frequency heating device comprises a first and a second radio frequency heating device, and wherein the distance along the lateral well between the first radio frequency heating device and the second radio frequency heating device is greater than 500 meters.

5. The method of claim 1, wherein the at least one radio frequency heating device comprises a first and a second radio frequency heating device, and wherein the distance along the lateral well between the first radio frequency heating device and the second radio frequency heating device is greater than 1,000 meters.

6. The method of claim 1, wherein the lateral well comprises a heel portion and a toe portion, wherein a first radio frequency heating device is placed within 20 meters of the heel portion of the lateral well and the distance along the lateral well between the first radio frequency heating device and a second radio frequency heating device is greater than 500 meters.

7. The method of claim 4, wherein the quality of steam along the lateral well is increased by the second radio frequency heating device to at least 95% steam and 5% liquid water.

8. The method of claim 1, wherein an activator is injected into the lateral well and the radio frequency heating device generates radio frequencies to specifically heat the activator.

9. The method of claim 1, wherein the steam assisted gravity drainage operation includes expanding solvent-steam assisted gravity drainage and cyclic steam stimulation operation.

10. The method of claim 1, further comprising a step b-1) after the step b): b-1) injecting an activator into the hydrocarbon formation.

11. The process of claim 10, wherein the activator is a halide compound or a metal containing compound.

12. The process of claim 11, wherein the halide compound comprises a metal from period 3 or period 4 of the periodic table.

13. The process of claim 11, wherein the activator comprises at least one of $AlCl_4^-$, $FeCl_4^-$, $NiCl_3^-$, and $ZnCl_3^-$.

14. The process of claim 1, wherein the at least one radio frequency heating device operates at radio frequencies from 50 to 500 MHz.

15. A method of decreasing steam assisted gravity drainage operating costs:

a) providing a vertical well connected to a pair of horizontal wells greater than 1000 meters in length, one horizontal well near the bottom of a pay zone, and the other horizontal well parallel to and 3-7 meters higher, b) placing at least one first radio frequency heating device in at least one horizontal well;

c) injecting steam in at least one horizontal well; and d) operating said radio frequency heating device to further heat said injection steam or water along the horizontal well.

16. The method of claim 15, wherein radio frequency heating devices are placed in each horizontal well.

17. The method of claim 15, wherein at least two radio frequency heating devices are placed in each horizontal well.

18. The method of claim 15, wherein said at least one radio frequency heating device operates at one or more frequencies to heat injection steam or water, or a wellbore of said at least one horizontal well.

19. The method of claim 15, wherein an activator is co-injected with said steam and said at least one radio frequency heating device operates at one or more frequencies to heat injection steam or water and said activator or a wellbore of said at least one horizontal well.

20. The method of claim 15, wherein said horizontal well is at least 1500 meters and there are at least two radio frequency heating devices therein.

21. The method of claim 15, wherein said horizontal well is at least 2000 meters and there are at least two radio frequency heating devices therein.

22. The process of claim 15, wherein the steam assisted gravity drainage operation includes expanding solvent-steam assisted gravity drainage or a cyclic steam stimulation operation.

23. The method of claim 15, wherein an activator is co-injected with said steam and said at least one radio frequency heating device operate at one or more frequencies to heat said injection steam or water and said activator or a wellbore of said horizontal well, and wherein there are at least two radio frequency heating devices in each horizontal well.

* * * * *